US008502075B2

(12) United States Patent
Emerson

(10) Patent No.: US 8,502,075 B2
(45) Date of Patent: Aug. 6, 2013

(54) HEATER CABLE TO PUMP CABLE CONNECTOR AND METHOD OF INSTALLATION

(75) Inventor: Tod D. Emerson, Cypress, TX (US)

(73) Assignee: Quick Connectors, Inc, Houston, TX (US)

( * ) Notice: Subject to any disclaimer, the term of this patent is extended or adjusted under 35 U.S.C. 154(b) by 260 days.

(21) Appl. No.: 12/921,137

(22) PCT Filed: Mar. 10, 2009

(86) PCT No.: PCT/US2009/036693

§ 371 (c)(1),
(2), (4) Date: Sep. 3, 2010

(87) PCT Pub. No.: WO2009/114550

PCT Pub. Date: Sep. 17, 2009

(65) Prior Publication Data

US 2011/0017510 A1 Jan. 27, 2011

Related U.S. Application Data

(60) Provisional application No. 61/035,203, filed on Mar. 10, 2008.

(51) Int. Cl.
*H01R 4/18* (2006.01)

(52) U.S. Cl.
USPC ..... 174/88 R

(58) Field of Classification Search
USPC ..... 174/88 R
See application file for complete search history.

(56) References Cited

U.S. PATENT DOCUMENTS

| | | | | |
|---|---|---|---|---|
| 3,040,284 | A * | 6/1962 | Connell | 439/320 |
| 3,657,513 | A * | 4/1972 | Howard | 219/200 |
| 3,692,922 | A * | 9/1972 | Sugimoto et al. | 174/73.1 |
| 4,144,404 | A * | 3/1979 | De Groef et al. | 174/88 C |
| 4,704,514 | A * | 11/1987 | Van Egmond et al. | 392/305 |
| 5,460,717 | A * | 10/1995 | Grimwood et al. | 210/175 |
| 5,732,771 | A * | 3/1998 | Moore | 166/65.1 |
| 6,269,876 | B1 * | 8/2001 | De Rouffignac et al. | 166/60 |
| 7,230,214 | B2 * | 6/2007 | Kirby | 219/535 |
| 2006/0005968 | A1 * | 1/2006 | Vinegar et al. | 166/302 |
| 2007/0137856 | A1 * | 6/2007 | McKinzie et al. | 166/245 |
| 2007/0161298 | A1 | 7/2007 | Moore | |
| 2008/0026623 | A1 | 1/2008 | Emerson | |
| 2008/0047711 | A1 * | 2/2008 | Hill | 166/302 |

* cited by examiner

*Primary Examiner* — Chau Nguyen
(74) *Attorney, Agent, or Firm* — David B. Dickinson

(57) ABSTRACT

The connector arrangement attaches the electrical conductors of a standard electrical submersible pump (ESP) cable to a mineral insulated (MI) resistance heater cable for use in oil and gas wells by conductively joining one or more of the electrical conductors of the ESP cable to a cold lead of the MI heater cable within an insulated sleeve covered and sealed within a protective cover. The connector thereby allows the MI heater cable and ESP pump cable to be joined to production tubing and then lowered into the well bore to the desired location.

7 Claims, 12 Drawing Sheets

HEATER CABLE TO PUMP CABLE CONNECTOR AND METHOD OF INSTALLATION

REFERENCE TO PRIOR APPLICATIONS

This application claims priority to U.S. Provisional Patent Application No. 61/035,203, filed 10 Mar. 2008, which is incorporated herein by reference.

BACKGROUND OF INVENTION

The present invention relates to a electrical connection for use with a heater cable in a well bore; more specifically, this invention claims an apparatus for connecting a electrical submersible pump cable to a heater cable to place the heater cable elements within a well bore distant from the source of electrical power for such heater cable.

There are many oilfield applications in which heating inside the well bore will enhance production. One type of down-hole heater consists of a single electrical conductor wire of high resistance (such as ni-chrome wire) which is placed concentrically inside a stainless steel, or other alloy metal tube (such as monel). To insulate the conductor from the outer tubing, an inert mineral insulation (MI) material (such as magnesium oxide) is often used. These down-hole resistance heaters are usually strapped to the production tubing, and power is supplied from the surface. In the case of oil wells, these heater cables are submerged in the oil-producing zone, and are used to raise the temperature of the oil, thereby lowering its viscosity to permit efficient flow of the oil to surface. In gas wells, these heaters can often be used to heat almost the entire length of the production tubing, to reduce the formation of scale, paraffin, and hydrates which can form in the production tubing and restrict or block flow.

Heaters of this type are usually powered by three-phase equipment at surface, so three individual heater tubes are typically strapped or banded to the production tubing. Close to surface, each of these tubes are connected to a "cold lead" section, or a section of tubing which is not meant to increase in temperature. Basically, the cold section consists of low resistance wires inside metal tubing. A cross-over type piece from the hot section to the cold section is assembled by the heater manufacturer, and installed prior to delivery.

The cold lead section typically passes through the surface wellhead, using metal ferrule type fittings. This arrangement works well for shallow well applications, in which the overall length of the hot and cold section is not more than 4,000 ft.

However, for deeper well applications, the manufacture of longer lengths of heater tubes is difficult, or impossible. At times, only a 300 foot section of pay zone in an oil well needs to be heated, but the pay zone is 7,500 feet below surface. It is not economical to manufacture a hot or cold section in these longer lengths.

The current patent application solves the above problem by providing a connector that will connect the three cold lead sections of a heater cable to the three individual wires from a typical Electrical Submersible Pump (ESP) cable, thereby providing a readily available solution to this problem of providing an electrical connection in high temperature, high pressure well bores.

ESP cable is much less expensive, easier to manufacture and procure than the MI Heater Cables. The connection of the present invention can allow for a short section of heater cable, a short section of cold lead cable, and a long length of ESP cable. ESP cable can be sealed off using several known means through the surface wellhead, providing an economical and efficient solution to the problem of increasing oil and gas production.

SUMMARY OF INVENTION

This present invention claims a heater cable to a pump cable connector for joining a cold lead of a heater cable having a stripped terminal end and a lead from a pump cable having a stripped terminal end by using a conductive sleeve joining the heater cable cold lead and the pump cable lead; an insulating boot covering the conductive crimp sleeve disposed inside a protective outer sleeve; a covering for the cold lead of the heater cable extending through a ferrule fitting and an extrusion limiting top stop retaining said stainless covering at a first end of said protective sleeve; epoxy coating and an extrusion limiting bottom stop of a second end of said protective outer sleeve; and, a ferrule fitting joining said cold lead to said stainless steel covering exterior to said outer protective sleeve.

Joining of the pump cable conductor to the cold lead of the heater cable conductor can be made by crimping the connector, welding, soldering, compressively fitting or gluing each end into the connector without departing from the spirit of this invention. Crimping is the preferred method of joining in the present embodiments.

This heater cable to pump cable connector is installed by running a production tubing into a well bore with a heater cable and cold lead section of said cable clamped to the production tubing; spacing the cold lead ends at their proximal ends and stripping each cold lead uniformly; installing ferrule tube fittings at each end of a cold lead section of the heater cable; installing a silicone filled tubing over each cold lead into each ferrule tube fitting and tightening the ferrule tube fittings; inserting the tubing in a top stop and install cold lead in the compressive fit insulator; stripping insulation extending from insulator to fit in a conductive sleeve; cleaning and inserting the cold lead into the sleeve; seating the sleeve against an edge of compressive fit insulator or standoff; positioning a top stop gage around silicone filled tubing and moving the top stop to seat adjacent the top stop gage and affixing to silicone filled tubing; removing the gage; inserting a butt plug into the opposing end of the crimp sleeve and lubricating the sleeve and cold lead with non-conductive silicone and sliding the female nonconductive boot over the assembly until the boot touches the top stop; and, removing the butt plug to enable completion of installation of pump cable stripped leads from triskelion tubes.

DETAILED DESCRIPTION OF EMBODIMENT

Figure 1:
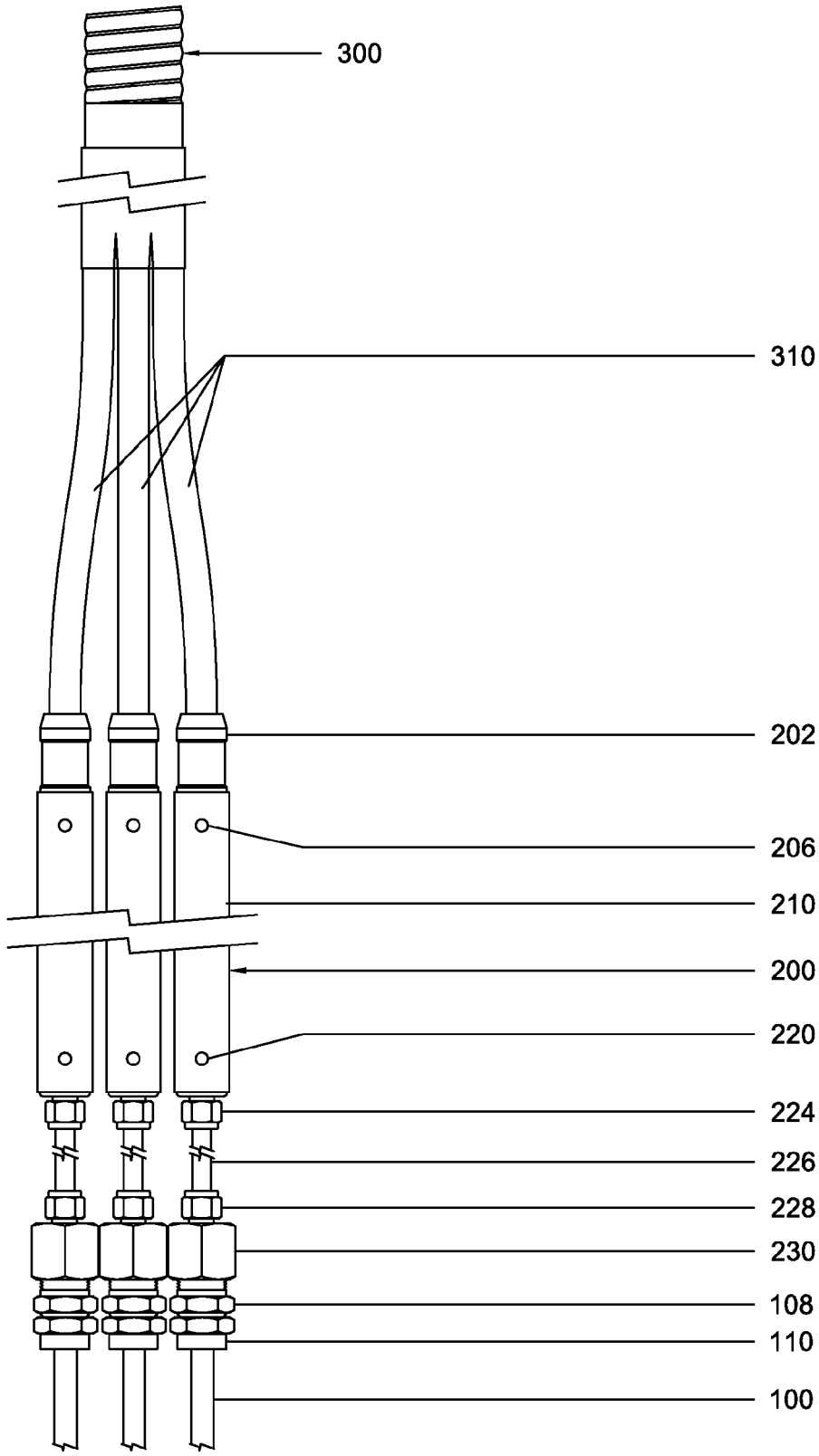
FIG. 1 is a side perspective view of pump cable to heater cable connector apparatus.

As may be readily appreciated from FIG. 1, pump cable 300 is split into the triskelion tubes 310 for each of the three conductors contained within the pump cable 300. These are joined in the connector 200 mating the two differing types of cables. The cold lead from the MI heater cable 100 is disposed in the well bore clamped on the production tubing (not shown). The cold lead connects through cable ferrule fittings 108 and 110 to Swagelok™ fitting 230, through stainless steel tubing 226 through ferrule fitting 224 connected to the top stop held in the outer sleeve by stop screws 220. Similarly, triskelion tubing 310 is inserted into the bottom stop 202 and into the outer sleeve 210 where it is retained by stop screws 206. The details of the interior of the connector are more clearly shown in FIG. 2.

Figure 2:
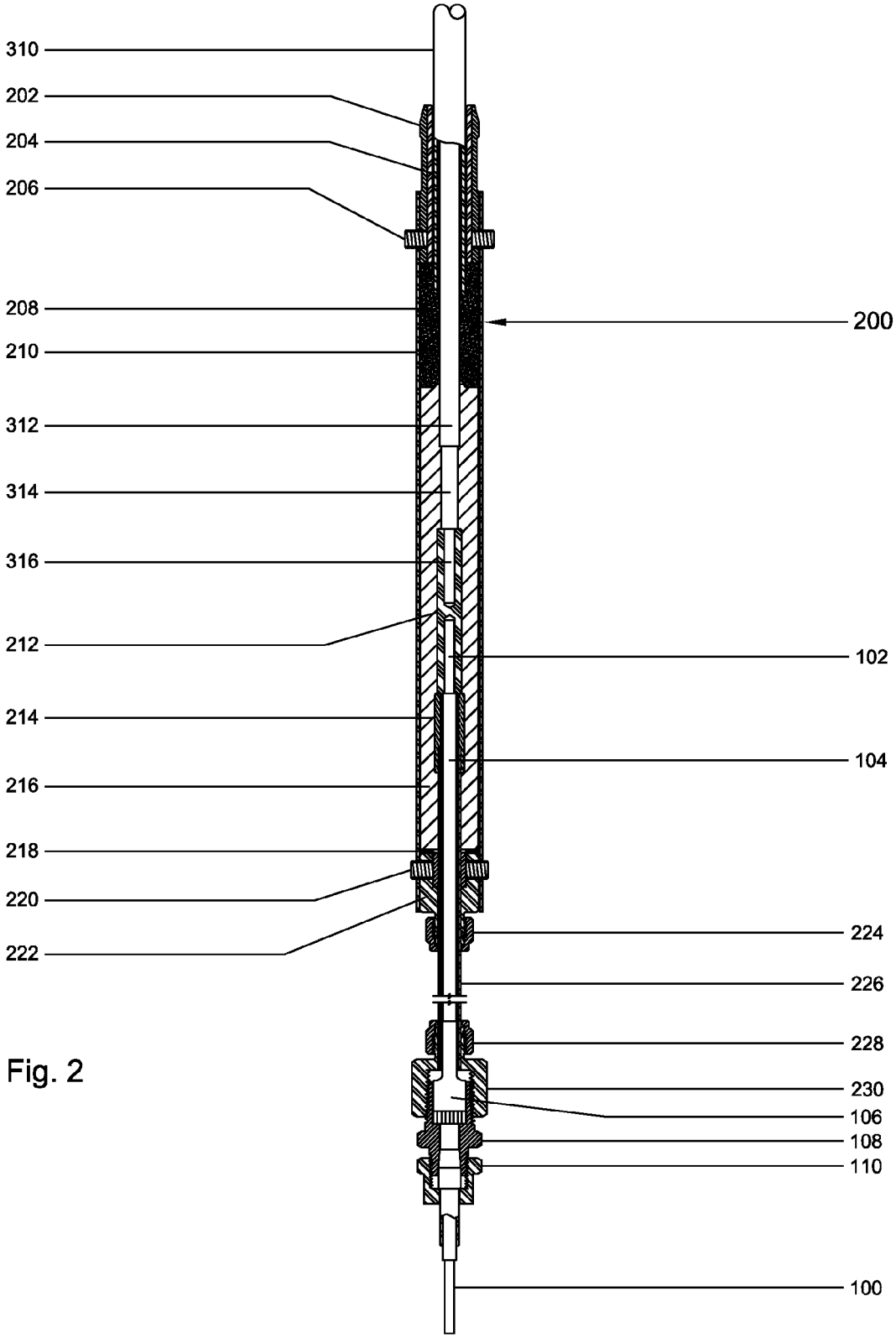
FIG. 2 is a side cross-sectional view of the pump cable to heater cable connector apparatus made with a crimp splice connector.

FIG. 2 is a cross-sectional side view of the connector 200. One leg of a triskelion tubing 310 from the ESP cable leads is inserted into the bottom stop 202 and a triskelion bushing 204 which are compressively retained in outer sleeve 210 by stop screws 206. The lead jacket 312 from the pump cable and the insulation 314 are stripped in a uniform manner leaving a bare pump cable conductor 316 which is inserted into a one-piece conductive crimp sleeve 212.

Similarly, as shown in FIG. 2, the MI heater cable conductor cold lead portion is inserted in the outer sleeve, stripped at its proximal end to expose a bare conductor 102 and inserted into the opposing end of the conductive crimp sleeve 212. The cold lead portion of the heater cable's insulation 104 is stripped to a measured position and a compressive fit insulating standoff 214, which has been previously filed with silicone holds the exposed end of the lead in spaced relationship with the crimp sleeve 212. The crimp sleeve 212, pump cable conductors 314 and heater cable cold lead conductor 104 are slipped inside a non-conductive rubber boot fabricated from ethylene propylene diene monomer (EPDM) rubber. The EPDM rubber used can be Centrilift compound #CL177E or Eagle Elastomer, Inc. compound #EE66465A. It is believed that a medium viscosity fluoroelastomer obtained from Solvay Solexis named Tecnoflon® BR 9151 can also be substituted for the EPDM rubber described above. A non-extrusion washer 218 surrounds the tubing that encloses the MI cable insulation and conductor and is retained with the outer sleeve 210 by stop screws 220 and a top stop 222. The top stop connects another ferrule fitting to retain the stainless steel tubing 226 within the body to provide a protective sleeve for the MI cable lead from the termination of the MI cable 106. Epoxy 208 is inserted in the proximal end of the outer sleeve 210.

Figure 3:
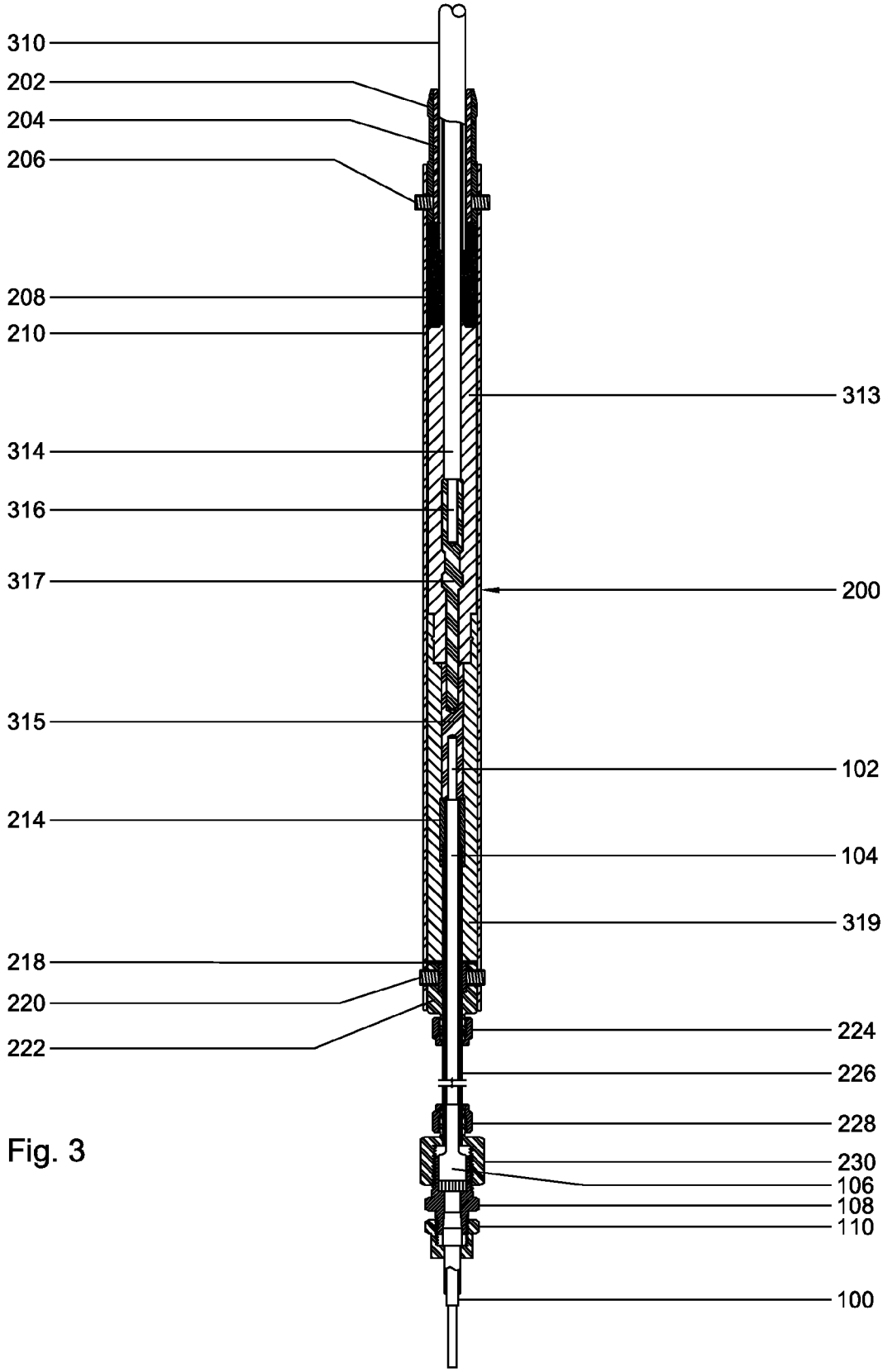
FIG. 3 is a side cross-sectional view of the pump cable to heater cable connector apparatus made with a male to female splice connector.

Alternatively, as shown in FIG. 3, the cold lead of the MI cable can be joined to the ESP cable leg of the triskelion tube using a male pin 317 which is attached to the stripped end 316 of the ESP cable, which is thereafter mated to the female connector 315 and joined to the stripped end of the cold lead 102. The female plug is covered with an insulating cover or boot 319 and the male plug is covered by a mating insulating cover 313, both of which are joined and covered by the outer protective sleeve 210, in the same manner describing the first embodiment above.

Figures 4A, 4B:
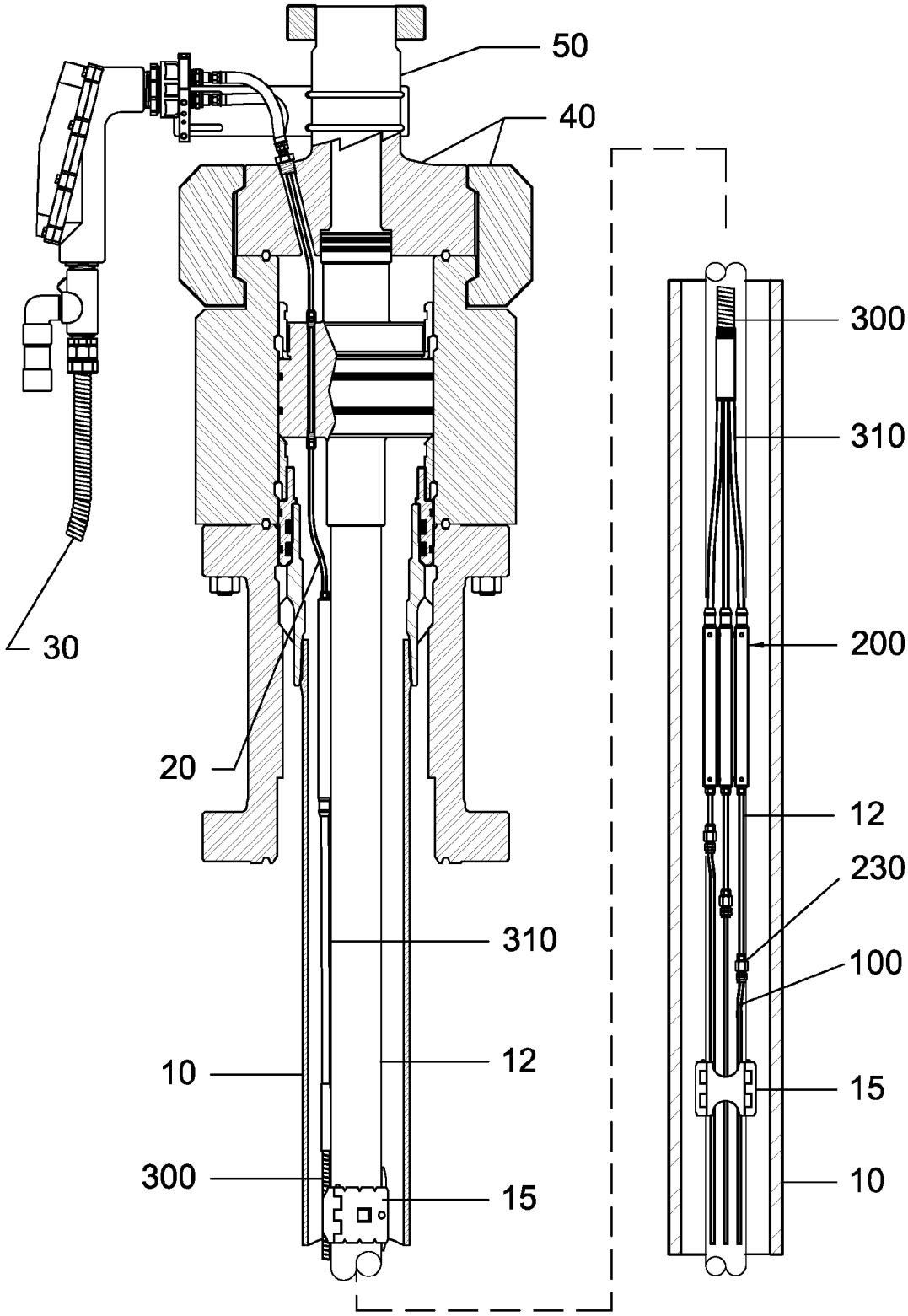
FIG. 4A is detailed view of a wellhead penetrator and production tubing showing the details of an deployment of the ESP cable to the MI heater cable splice embodiment of the present invention.
FIG. 4B is a detailed view of the attachment of ESP cable/MI heater cable to the production tubing near the desired deployment of the heater cable in the well.

The manner of inserting the ESP cable in the well bore to attach by the connector to a MI heater cable can best be visualized by reviewing FIGS. 4A-4B. A surface cable 30 supplies electrical service to a bracketed 50 wellhead penetrator with each of the electrical conductors inserted through a tubing adaptor 40 in said well head. Each conductor is guided by penetrator 20 into the ESP cable supplying power to the well bore. The wellhead supports a casing string 10 that has inserted therein a production tubing 12 to which the ESP cable has been previously clamped 15. The ESP cable 300 in this view has been previously attached to the heater cable connectors 200, all as previously described and shown in FIG. 4A.

Directing our attention to FIG. 4B, the entire heater cable assembly 200 is connected with the Swagelok™ ferrule fittings 230 previously described, clamped to the production tubing 12 and lowered to the desired heater activation point as the production tubing was lowered into the casing string 10.

Figure 5:
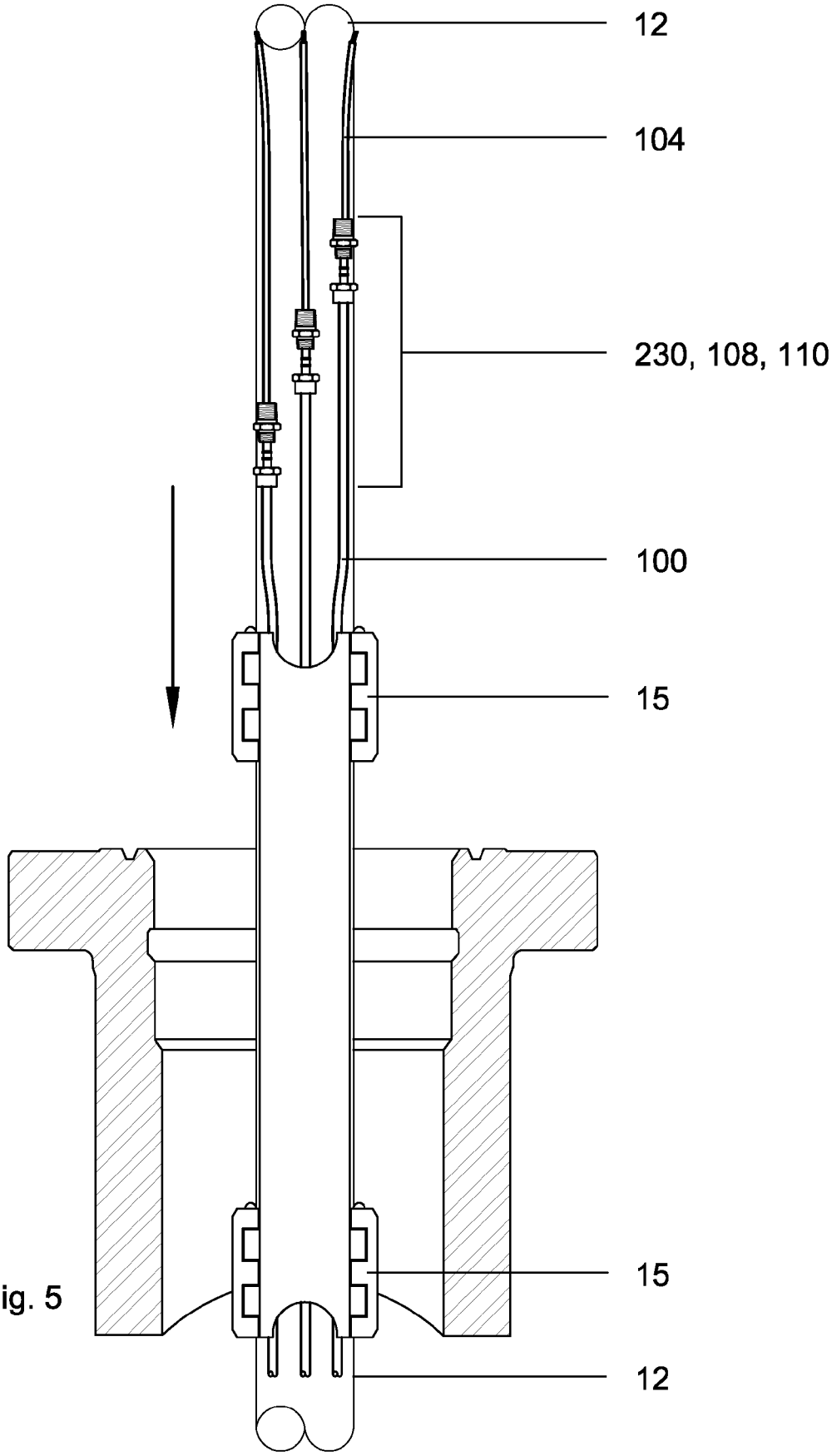
FIG. 5 is an exploded composite view of the cold lead ferrule attachment of the MI cable ready to be spliced to the ESP cable and lowered in the well bore.

Having viewed the completed assembly of FIGS. 4A-4B, one may commence understanding of the method of assembly by directing one's attention to FIG. 5 which shows the production tubing 12 held by conventional means not shown in this view in the well bore. As the MI heater cable is clamped to the production tubing 12, the tubing is lowered into the well bore. After the MI heater cable hot portion is disposed, the heater cable attaches to low resistance "cold" conductors for some length. The production tubing 12 is lowered into the well bore with the MI heater cable and the cold lead section clamped to the tubing. The ends of the cold lead 104 are spaced approximately 1½" apart and stripped of their insulation as evenly as possible to reveal the conductor 102, which can be either strands (as shown) or solid conductor.

Figure 6A:
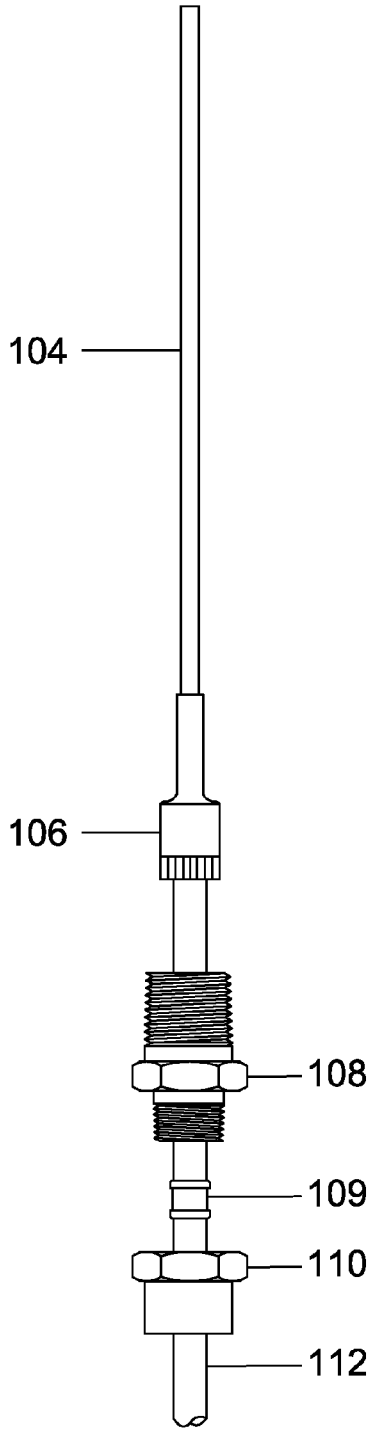
FIG. 6A-6E are detailed views of a partially assembled cold lead ferrule attachment as it is prepared for connection to the bottom stop of the splice arrangement of one embodiment of this invention.
Figure 6B:
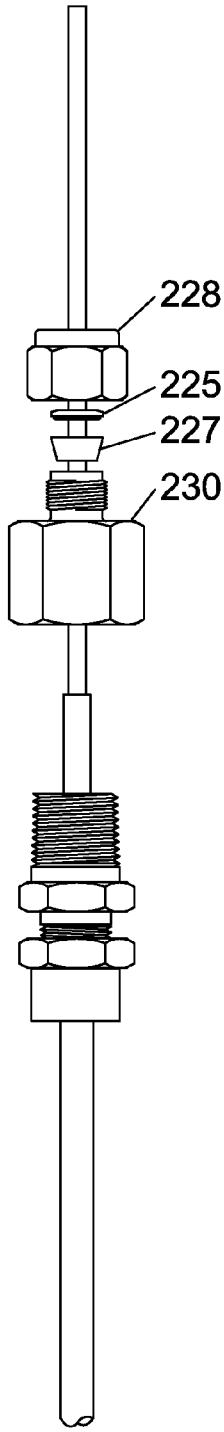
Figure 6C:
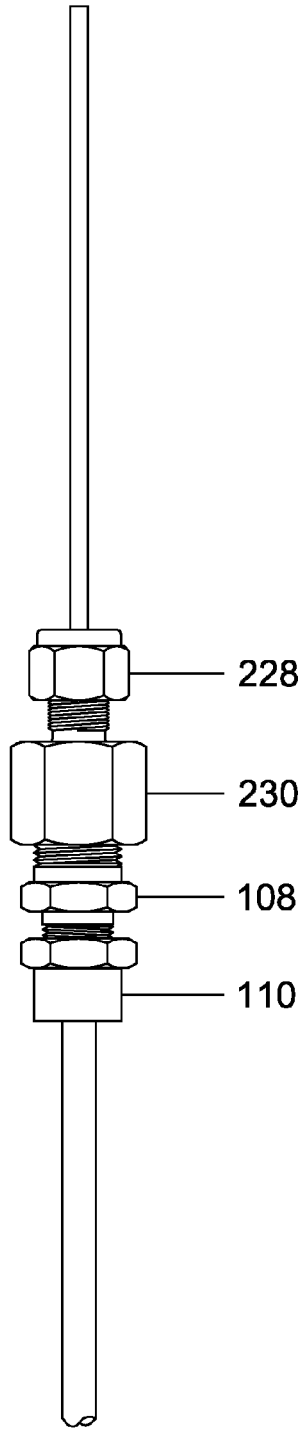

FIG. 6A-6E describe the steps in installing the tube fittings 108, 110, 230 and 228 on the cold lead portion 100 of the heater cable in preparation for installation. It is believed that the end termination consists of a thermal gradient section butt-connected to a 19-strand THWN cold leads. The cold leads are crimped and soldered to the thermal gradient section, insulated with a high-dielectric tape, and epoxy potted in a brass sleeve. The epoxy pot is shown at 106. An installer would slide on the tube fittings 108 to the end of the cold lead tube section 106 then tighten the nut 110. The installer would cover the threads of the ferrule body 108 with Teflon™ tape then slide the Swagelok™ fitting 230 over the wire and tighten it against the fitting body 108 as shown in FIGS. 6B and 6C to join the cold lead section of the MI cable 100 and provide the means for connection to the ESP cable.

Figure 6D:
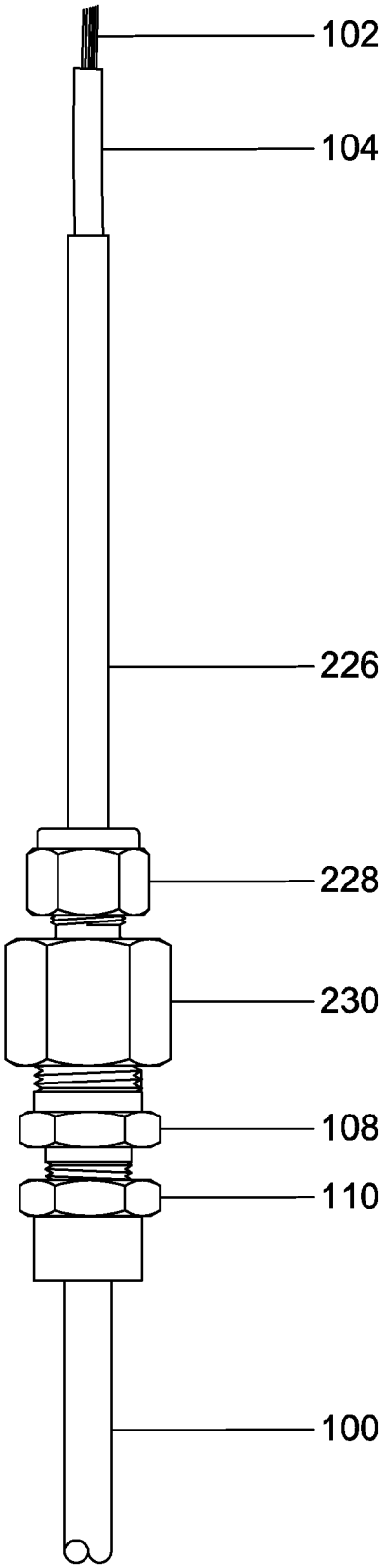
Figure 6E:
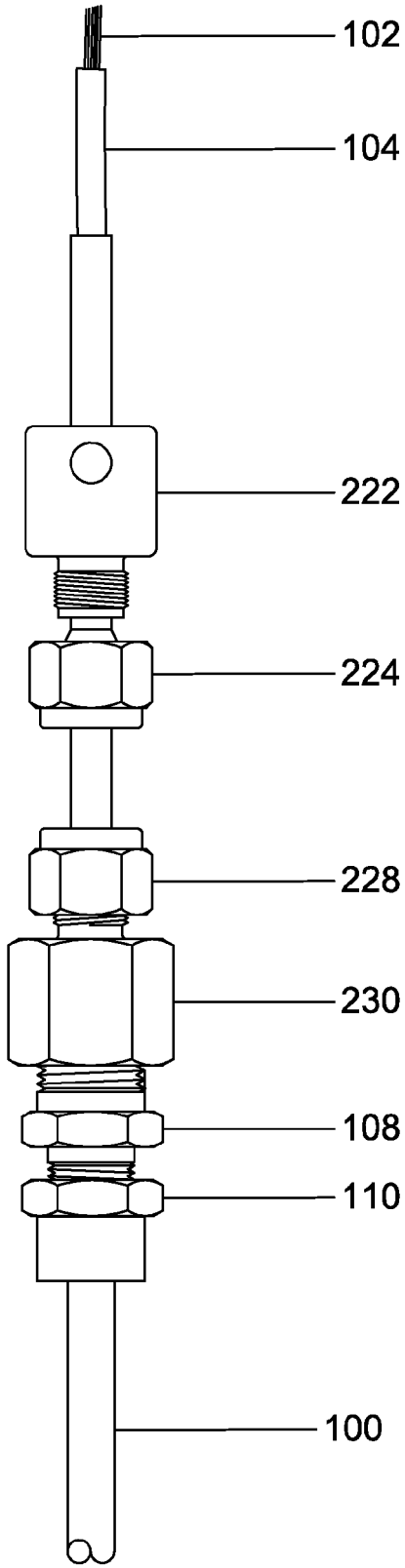

Next, as shown in FIG. 6D, a short section of stainless steel tubing 226 filled with silicone is run over the end of the cold lead section into tubing nut 228 which is then tightened to hold the tubing 226 in Swagelok™ assembly 228, 230 on the cold lead of the heater cable. This process is repeated for each leg of the three electrical cold leads leading to the heater cable. As shown in FIG. 6E, the top stop 222 and nut 224 are installed over the tubing 226 in preparation for the joinder of the cold lead cable to the ESP cable.

Figure 7:
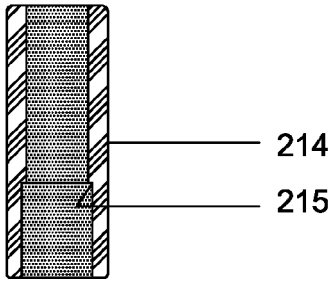
FIG. 7 is a cross sectional view of the insulator member or insulating standoff of the present embodiment.
Figure 8:
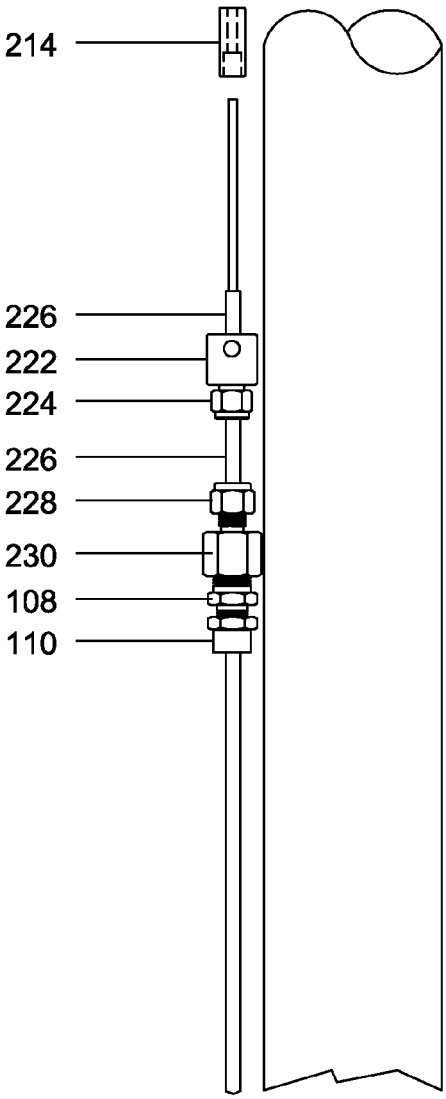
FIG. 8 is a composite view of the manner of attachment of various components to the cold lead conductor of the heater cable and the installation of the insulator member in preparation for completion of the ESP/MI cable splice.
Figure 9:
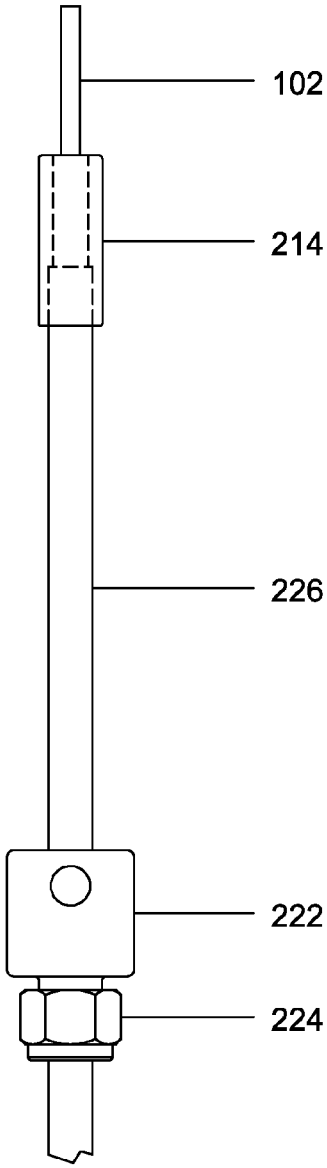
FIG. 9 is a composite view of the insulating standoff located on the stripped end of the cold lead of the MI heater cable ready for the installation of the splice cover.

FIG. 7 details the insulating standoff, an insulator positioned at the proximal end of the stainless steel tubing 226, which seats on an internal shoulder 215. An alternative embodiment for this insulating standoff could be formed from an insulator, a stainless steel counter-bored washer accepting the end of the protective tubing and a stainless steel washer on the opposing side of the insulating standoff without departing from the spirit of this invention. The insulating material can be fabricated from any heat resistant insulating material having appropriate mechanical properties and the preferred material is an alumina ceramic material consisting of nominally 99.5% $Al_2O_3$ commercially available from Coorstek™ as AD-995. As suggested in FIGS. 8 and 9, the installer would clean the protective tubing 226 with contact cleaner and dry. After installation of the top stop 222 and nut 224, the insulating standoff 214 is twisted onto the end of the insulated conductor 104, and the insulation on the conductor is cut back to be flush with the upper surface of the insulating standoff 214, which is trimmed to leave approximately 1¼" exposed conductor 102 to fit the crimp splice connector 212 of FIG. 2 or the female conductor connector 315 of FIG. 3.

Figure 10:
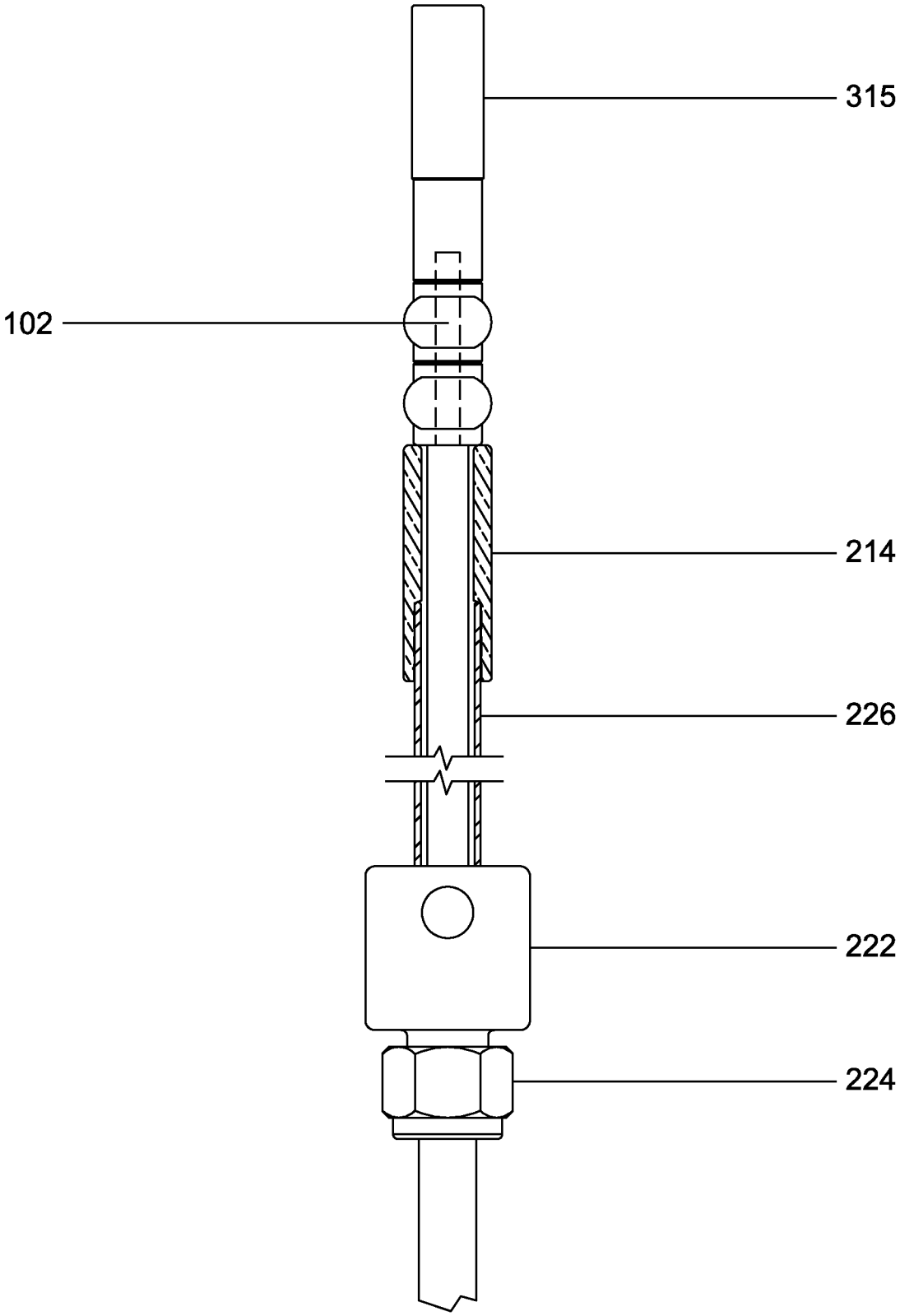
FIG. 10 is a composite view of the manner of attachment of the crimp socket and the female boot to the cold lead of the heater cable.

FIG. 10 details the steps next following the insertion of the insulating standoff 214. The conductor 102 is cleaned to remove any residual silicone left on the conductor after installation of the insulating standoff 214 and inserted into the female conductor connector 315 and crimped. If the crimp socket shown in FIG. 2 is to be used, the crimp socket 212 is pushed over the end of the conductor 102 until the end of the crimp socket 212 seats against the upper edge of the insulating standoff 214. The socket is crimped twice to affix the crimp socket to the conductor. Whether using the crimp socket of FIG. 2 or the female connector of FIG. 3, this step is performed on each of the two remaining cold lead conductors until all are complete.

The spacing of the connector in both embodiments is important in establishing the integrity of the connection between the ESP cable and the MI cable. If the male/female conductive sleeve assembly is to be used, the female conductor 315 is joined to the stripped end of the cold lead 102, after the insulating standoff is placed over the cold lead jacket. Similarly, if the crimp sleeve 212 is used as described in FIG. 2, it is installed after the insulating standoff 214 is placed on the conductor 104.

Figure 11:
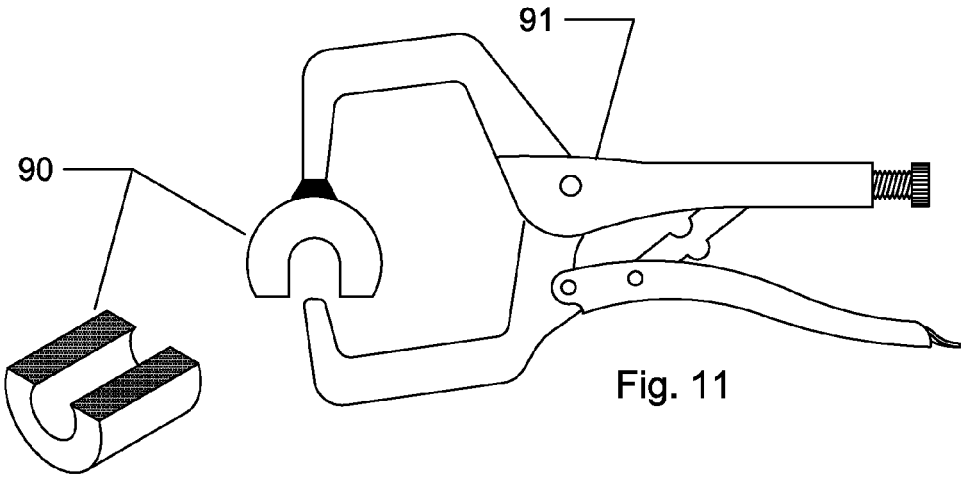
FIG. 11 is a vise-grip spacer tool used for proper spacing the splice boots over the crimp splice and conductors.
Figure 12A:
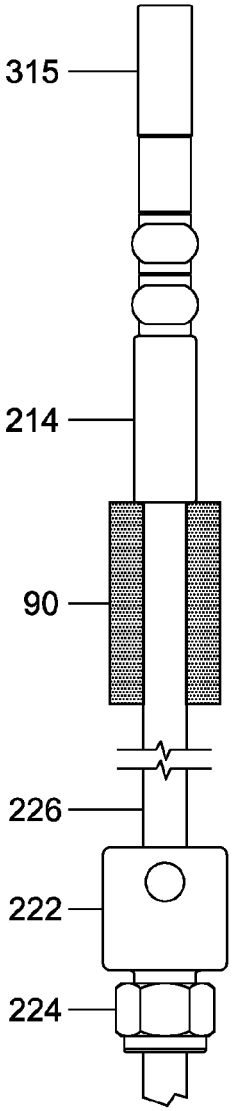
FIG. 12A-E is a series of installation steps showing the use of the vise-grip spacer tool for the placement of the bottom stop on the crimp splice boot on the conductor line.
Figure 12B:
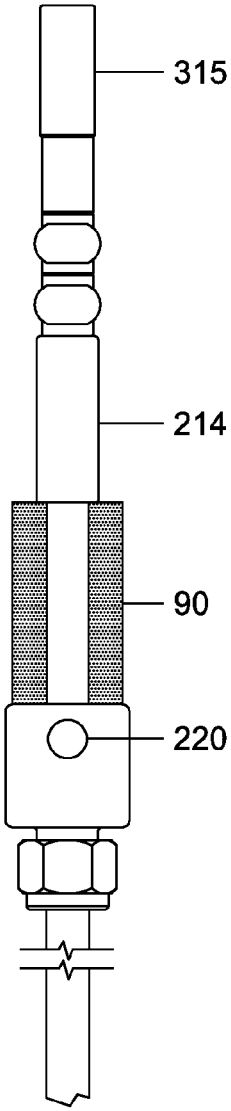
Figure 12C:
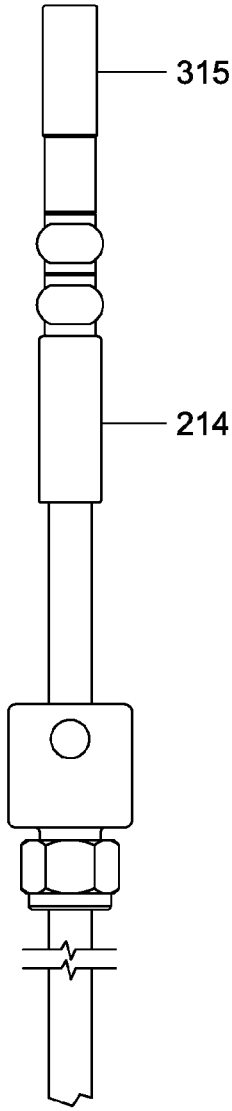

FIG. 11 describes the process to locate the top stop in spaced relation with the insulating standoff and crimp socket to enable the EPDM sleeve to cover the assembly properly illustrating the female connector conductor. A top stop gage 90 is inserted in a specially prepared vise-grip wrench 91 and placed immediately adjacent the insulating standoff 214 as shown in FIG. 12A. The gage allows the top stop 222 and nut 224 to be moved up to the proper location where they are joined and tightened to fix the stainless steel tube 226 in the position to accept the location of either the insulating boot 216 of FIG. 2 or the bottom female insulation boot 319 of FIG. 3. The gage 90 is then removed from the stainless steel tubing 226. FIGS. 12A-12C show the progression of the placement of the gage on the stainless steel tubing; the top stop 222 is then moved to seat between the insulating standoff 214 and the connector 315 and set with set-screws 220. The method of installation for the crimp sleeve 212 shown in FIG. 2 proceeds similarly.

Figure 12D:
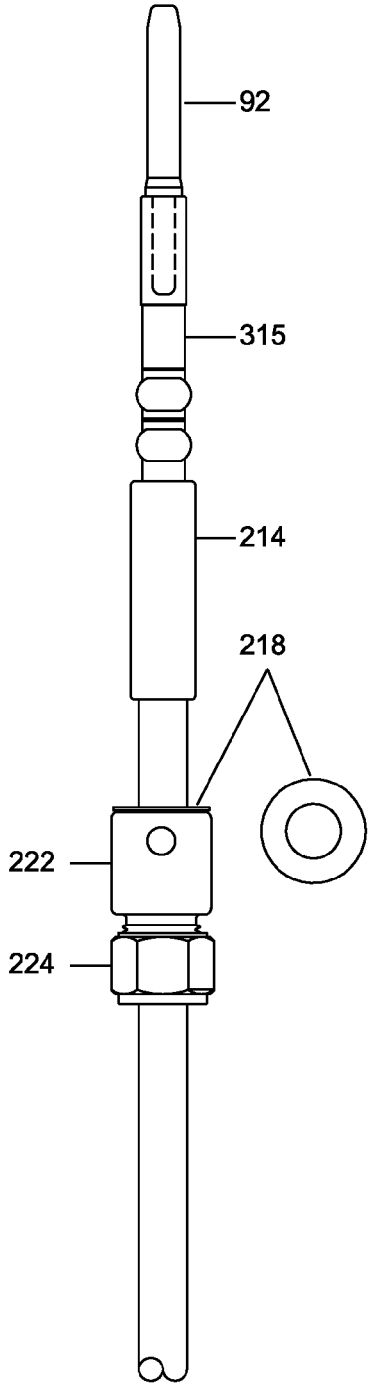
Figure 12E:
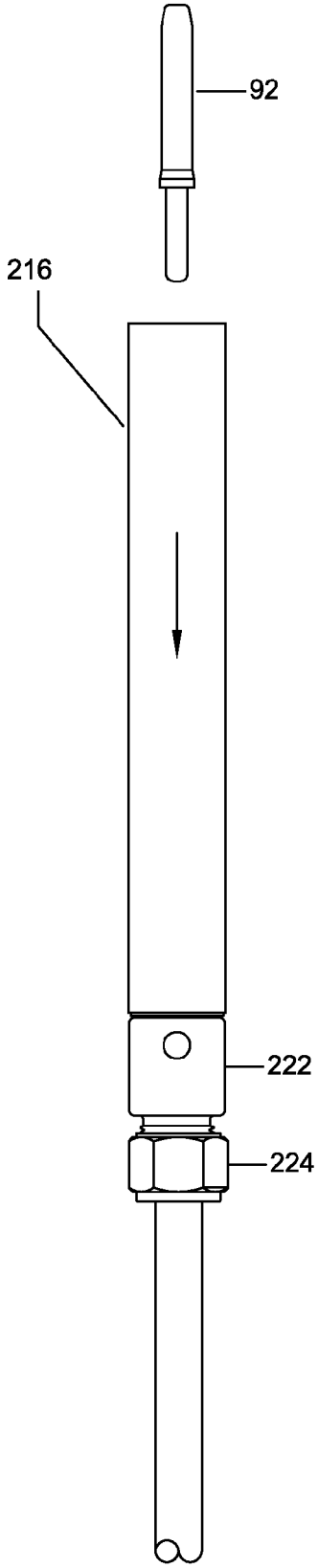

FIG. 12D shows the last assembly step of slipping a non-extrusion washer 218 over the connector and insulating standoff to the top stop 222. A butt plug 92 is inserted into the ESP cable end of the crimp socket 315 to facilitate enclosure within the insulating sleeve 319. A non-extrusion washer 218 is placed over the butt plug 92 and moved to seat on the upper edge of the top stop 222 now fixed in position. The entire assembly is then lubricated with silicone compound and a female boot 216 is run over the butt plug 92 by rotating the boot until it seats against the non-extrusion washer 218. The silicone assists in the installation of the insulating boot. The boot should be checked to determine whether it is uniformly round and straight without bulges that would reflect that it has not properly seated itself on the washer. The insulating standoff 214 should not be bent or moved by this step. The butt plug 92 is then removed.

Installation of the crimp splice 212 proceeds in a similar manner. All of the exterior covers are deployed on the cold lead in preparation for being moved up over the crimp splice 212 and insulating boot or sleeve 216, after the insulating standoff 214 is placed over the exposed portion of the cold lead 102 and the protective tubing 226 seats on the insulating standoff shoulder 215. This installation requires each of the pieces of the splice connection be installed over the cold lead portion 226 of the MI cable so that the last connective step of crimping the splice 212 joins all together. Once the crimps are made, the boot is moved over the splice connector and insulating standoff and the end caps and epoxy installed and protective outer cover moved into place and sealed.

Figure 13A:
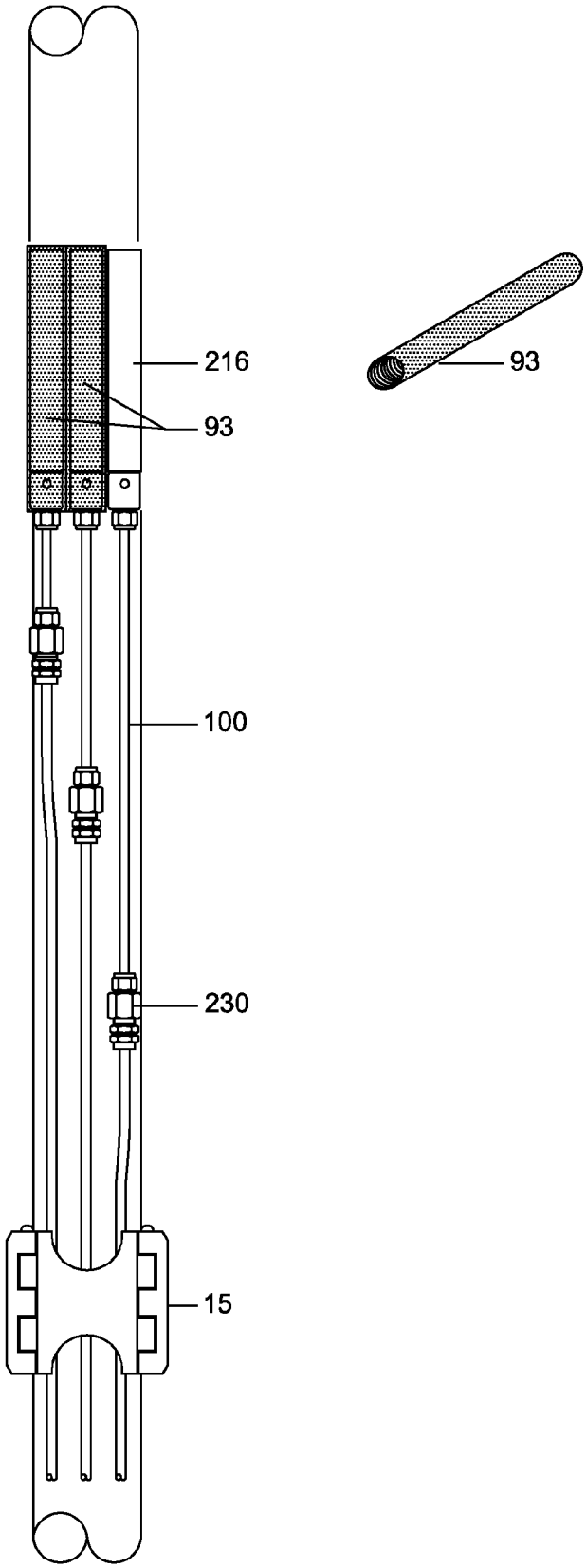
FIG. 13A is a side view of the completed assembly with the female insulating boot surrounding the cold lead from the heater cable and awaiting the installation of the ESP cable from the triskelion, including the protective cap which is installed temporarily to prevent contaminants from entering the upward facing female boot.
Figure 13B:
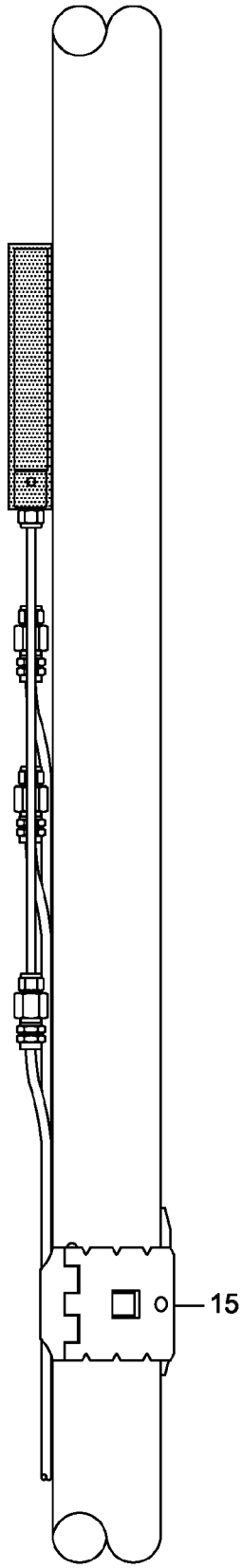
FIG. 13B is a side profile view of the installed female insulating boot surrounding the cold lead from the heater cable and awaiting the installation of the ESP cable form the triskelion.

As shown in FIGS. 13A-B, a small plastic cap 93 can be inserted over each end of the female insulating boots 216 to prevent junk from entering the crimping socket as installation proceeds. Additional clamps 15 are installed to hold the heater cable to ESP cable connector in proper position. The female boots are now ready for the installation of the ESP cable. As shown in FIG. 3, the male connector 317 is covered with insulating boot 313 and slid into engagement with the female receptacle 315 now covered by boot 319. The outer cover 210 is slid into place, epoxy 208 added to seal and allowed to cure.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. A connector joining a heater cable having one or more cold leads extending from a mineral insulated cable to a pump cable having a plurality of electrical conductors comprising:

a conductive sleeve assembly joining one or more of a terminal end of the one or more heater cable cold leads and a terminal end of one or more pump cable conductor leads;

an insulating boot covering the conductive sleeve assembly and being disposed inside a protective outer sleeve;

a cold lead tubing enclosing a cold lead of the heater cable, said cold lead tubing having an extrusion limiting top stop retaining said cold lead tubing at a first end of said protective outer sleeve in a predetermined spaced longitudinal placement with the conductive sleeve assembly; and, said protective outer sleeve providing an epoxy coating adjacent an extrusion limiting bottom stop at a second end of said protective outer sleeve.

2. The heater cable to pump cable connector of claim 1 wherein the conductive sleeve assembly is composed of a single conductive sleeve into which a cold lead and a pump cable conductor are both inserted and joined in the predetermined spaced longitudinal placement.

3. The heater cable to pump cable connector of claim 2 wherein a stripped ends of the one or more heater cable cold leads and the one or more pump cable electrical conductors are joined in a single splice sleeve by a method selected from the following: crimping, welding, soldering, compressive fitting, or gluing.

4. The heater cable to pump cable connector of claim 1 wherein the conductive sleeve assembly is composed of a male plug joined to the pump cable and covered in an insulating sleeve, then inserted in a female conductive receptacle, covered in a mating insulating sleeve, and joined to the cold lead end of the heater cable at the predetermined spaced longitudinal placement.

5. The heater cable to pump cable connector of claim 4 wherein the male plug is joined to a pump cable lead and the female conductive receptacle is joined to a cold lead end by a method selected from the following: crimping, welding, soldering, compressive fitting, or gluing.

6. A method of connecting a heater cable to a pump power cable comprising:

joining a cold lead trimmed terminal end of a heater cable and a trimmed end of an electrical conductor of a pump power cable in a conductive sleeve;

insulating the conductive sleeve in an insulative sleeve; and, affixing a protective cover over said insulative sleeve by connecting a stainless steel tubing over the cold lead of the heater cable and a triskelion tubing covering the at least one of the electrical conductors of the pump power cable to seal and to maintain the terminal ends of each heater cable and pump power cable within said protective cover in a predetermined spaced and sealed relationship.

7. An improved method of installing a heater cable to a pump power cable, said heater cable having one or more cold leads extending from a mineral insulated cable to a pump power cable having plurality of electrical conductors providing a conductive sleeve assembly joining one or more of a terminal end of one or more heater cable cold leads and a terminal end of one or more pump cable conductor leads; an insulating boot covering the conductive sleeve assembly and being disposed inside a protective outer sleeve; a cold lead tubing enclosing a cold lead of the heater cable, said cold lead tubing having an extrusion limiting to stop retaining said cold lead tubing at a first end of said protective outer sleeve in a predetermined spaced longitudinal placement with the conductive sleeve assembly; and said protective outer sleeve providing an epoxy coating adjacent an extrusion limiting bottom stop at a second end of said protective outer sleeve wherein the improvement comprises the steps of:

running a production tubing into a well bore with a heater cable of a predetermined length and providing at least one heater cable cold lead section of said heater cable, having said heater cable clamped to the exterior of the production tubing;

spacing a cold lead ends at its terminal distal end and stripping each cold lead tubing end uniformly;

installing a ferrule tube fitting at each end of the one or more cold lead tubing of the heater cable;

installing a silicone filled tubing over each cold lead tubing of the heater cable into each ferrule tube fitting and tightening the ferrule tube fittings to affix the cold lead tubing to the heater cable and cold lead connection;

inserting the cold lead tubing in a top stop;

inserting the one or more cold lead tubing ends of the heater cable in a conductive sleeve assembly;

cleaning and inserting the cold lead tubing end of the heater cable into the conductive sleeve assembly and seating the conductive sleeve assembly against the edge of an insulating standoff;

positioning a top stop gage around the silicone filled tubing and moving the top stop to seat adjacent the top stop gage and affixing the top stop to the silicone-filled tubing;

removing the top stop gage;

inserting a butt plug into an opposing end of the conductive sleeve assembly and lubricating the conductive sleeve assembly and cold lead tubing of the heater cable with non-conductive silicone and sliding a nonconductive boot over the conductive sleeve assembly until the boot seats against the top stop;

removing the butt plug to enable completion of the installation of one or more of pump cable leads from one or more triskelion tubes;

lowering the production tubing with the pump cable attached to the heater cable to a desired location within a well bore; and, energizing the pump power cable at a well head to resistively the well bore adjacent the heater cable.

* * * * *